US006618658B1

(12) United States Patent
Kagoshima et al.

(10) Patent No.: US 6,618,658 B1
(45) Date of Patent: Sep. 9, 2003

(54) CONTROL APPARATUS FOR A HYDRAULIC EXCAVATOR

(75) Inventors: Masayuki Kagoshima, Kobe (JP); Hideki Kinugawa, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 0 days.

(21) Appl. No.: 09/482,088

(22) Filed: Jan. 13, 2000

(30) Foreign Application Priority Data

Jan. 14, 1999 (JP) ..... 11-007800

(51) Int. Cl.[7] ..... G06F 7/70; G06F 19/00; E21D 9/06

(52) U.S. Cl. ..... 701/50; 318/569; 700/50

(58) Field of Search ..... 701/50; 318/569, 318/600, 568.16, 574; 700/50; 706/4, 52, 900; 37/348, 907, 414; 172/4, 2, 4.5; 414/699

(56) References Cited

U.S. PATENT DOCUMENTS

| | | | | |
|---|---|---|---|---|
| 5,047,701 A | * | 9/1991 | Takarada et al. | 318/568.1 |
| 5,186,579 A | * | 2/1993 | Hanamoto et al. | 405/143 |
| 5,312,163 A | * | 5/1994 | Hanamoto et al. | 299/1.8 |
| 5,682,312 A | * | 10/1997 | Rocke | 364/424.07 |
| 5,699,247 A | | 12/1997 | Moriya et al. | 364/424.07 |
| 5,768,810 A | * | 6/1998 | Ahn | 37/348 |
| 5,784,945 A | | 7/1998 | Krone et al. | 91/361 |
| 5,953,838 A | * | 9/1999 | Steenwyk | 37/348 |
| 5,994,865 A | * | 11/1999 | Phelps et al. | 318/569 |
| 5,999,872 A | | 12/1999 | Kinugawa et al. | 701/50 |

FOREIGN PATENT DOCUMENTS

| | | |
|---|---|---|
| EP | 0 301 096 | 2/1989 |
| EP | 0 609 445 | 8/1994 |
| EP | 0 795 651 | 9/1997 |
| EP | 0 851 122 | 7/1998 |

OTHER PUBLICATIONS

Patent Abstracts of Japan, JP 10–018355, Jan. 10, 1998.
Patent Abstracts of Japan, JP 9–217702, Aug. 19, 1997.
Patent Abstracts of Japan, vol. 1995, No. 03, Apr. 28, 1995, JP 06 336747, Dec. 6, 1994.

* cited by examiner

*Primary Examiner*—Tan Q. Nguyen
*Assistant Examiner*—Dalena Tran
(74) *Attorney, Agent, or Firm*—Oblon, Spivak, McClelland, Maier & Neustadt, P.C.

(57) ABSTRACT

The control apparatus for a hydraulic excavator according to the present invention comprises: an operating amount sensor for detecting operating amounts of operating levers; a characteristic amount extraction portion for operating the characteristic amounts on the basis of the operating amount; a membership function memory portion for storing a plurality of membership functions; a fitness operation portion for operating fitnesses with respect to works for the characteristic amounts by applying the operated characteristic amounts to the membership functions; an operating characteristic set value memory portion for storing preset operating characteristic set values; and an operating characteristic operation portion for outputting the operating characteristic for controlling a hydraulic excavator on the basis of the fitnesses operated corresponding to a plurality of kinds of work and the stored operating characteristic set values. Therefore, the operating characteristic of the hydraulic excavator can be enhanced.

6 Claims, 9 Drawing Sheets

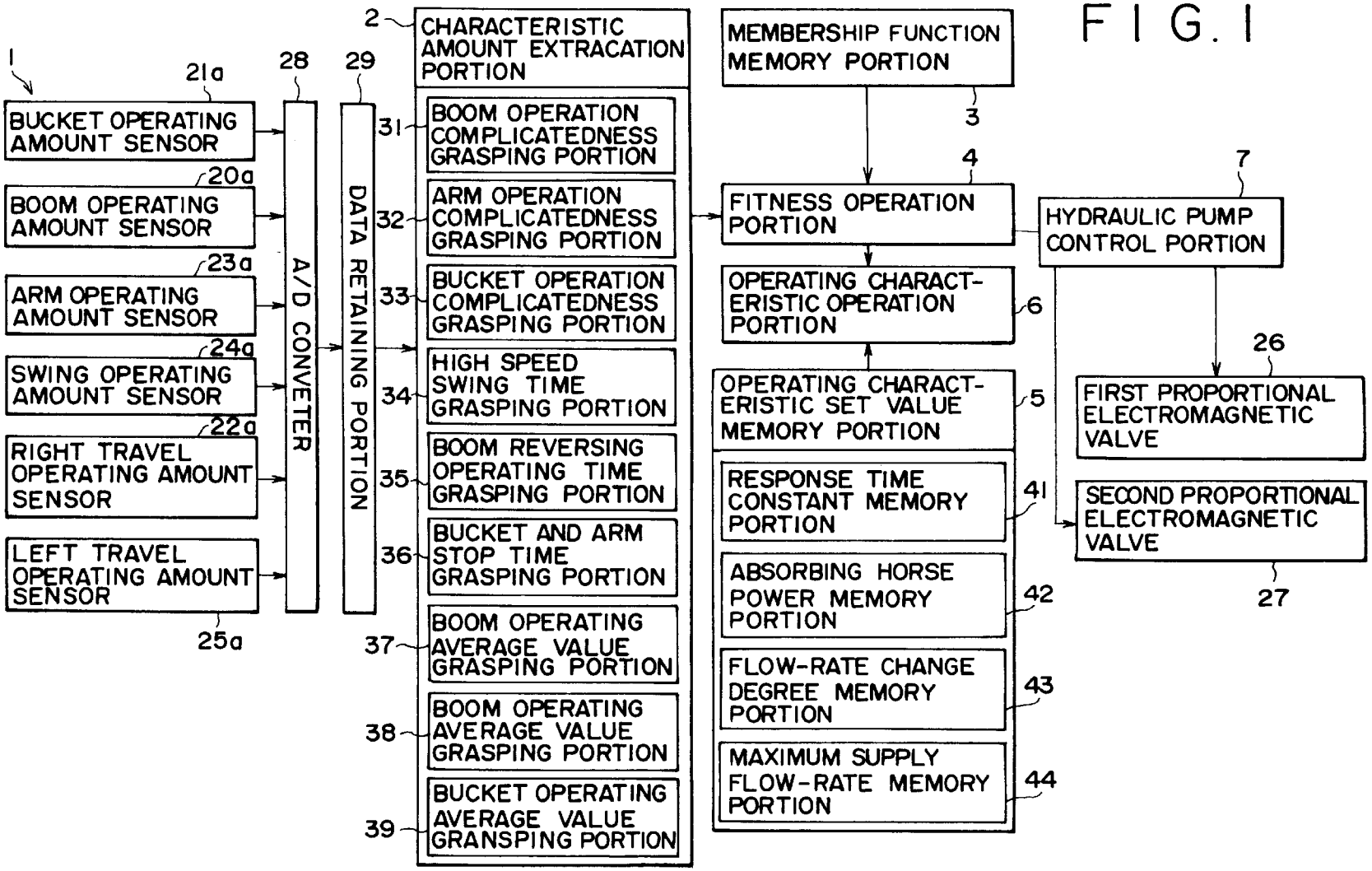
FIG. 1
1
BUCKET OPERATING AMOUNT SENSOR
21a
BOOM OPERATING AMOUNT SENSOR
20a
ARM OPERATING AMOUNT SENSOR
23a
SWING OPERATING AMOUNT SENSOR
24a
RIGHT TRAVEL OPERATING AMOUNT SENSOR
22a
LEFT TRAVEL OPERATING AMOUNT SENSOR
25a
A/D CONVETER
28
DATA RETAINING PORTION
29
CHARACTERISTIC AMOUNT EXTRACATION PORTION
2
BOOM OPERATION COMPLICATEDNESS GRASPING PORTION
31
ARM OPERATION COMPLICATEDNESS GRASPING PORTION
32
BUCKET OPERATION COMPLICATEDNESS GRASPING PORTION
33
HIGH SPEED SWING TIME GRASPING PORTION
34
BOOM REVERSING OPERATING TIME GRASPING PORTION
35
BUCKET AND ARM STOP TIME GRASPING PORTION
36
BOOM OPERATING AVERAGE VALUE GRASPING PORTION
37
BOOM OPERATING AVERAGE VALUE GRASPING PORTION
38
BUCKET OPERATING AVERAGE VALUE GRANSPING PORTION
39
MEMBERSHIP FUNCTION MEMORY PORTION
3
FITNESS OPERATION PORTION
4
OPERATING CHARACT-ERISTIC OPERATION PORTION
6
OPERATING CHARACT-ERISTIC SET VALUE MEMORY PORTION
5
RESPONSE TIME CONSTANT MEMORY PORTION
41
ABSORBING HORSE POWER MEMORY PORTION
42
FLOW-RATE CHANGE DEGREE MEMORY PORTION
43
MAXIMUM SUPPLY FLOW-RATE MEMORY PORTION
44
HYDRAULIC PUMP CONTROL PORTION
7
FIRST PROPORTIONAL ELECTROMAGNETIC VALVE
26
SECOND PROPORTIONAL ELECTROMAGNETIC VALVE
27

FIG. 12

| CHARACTERISTIC AMOUNT | SYMBOL | CONTENT |
|---|---|---|
| BOOM OPERATING COMPLICATEDNESS | ch1 | BOOM OPERATING AMOUNT=MINIMUM VALUE OF NUMBER OF POINT OF INTERSECTION -10.0, -5.0, 5.0, 10.1 |
| BUCKET OPERATING COMPLICATEDNESS | ch2 | BUCKET OPERATING AMOUNT=NUMBER OF POINT OF INTERSECTION WITH -5.0 |
| HIGH SPEED SWING TIME | ch3 | NUMBER OF TIMES IN WHICH SWINGING OPERATING AMOUNT ≧ 30.0 |
| BUCKET AND ARM STOP TIME | ch4 | NUMBER OF TIMES: \|BOOM OPERATING AMOUNT\| > 3.0 AND \|ARM OPERATING AMOUNT\| > 3.0 AND \|BUCKET OPERATING AMOUNT\| > 3.0 |
| BOOM REVERSING OPERATING TIME | ch5 | NUMBER OF TIMES: BOOM OPERATING AMOUNT > 3.0 AND ARM OPERATING AMOUNT > 3.0 AND BUCKET OPERATING AMOUNT < -3.0 |
| BOOM OPERATING AMOUNT AVERAGE VALUE | ch6 | ABSOLUTE VALUE AVERAGE OF BOOM OPERATING AMOUNT |
| ARM OPERATING AMOUNT AVERAGE VALUE | ch7 | ABSOLUTE VALUE AVERAGE OF ARM OPERATING AMOUNT |
| BUCKET OPERATING AMOUNT AVERAGE VALUE | ch8 | ABSOLUTE VALUE AVERAGE OF BUCKET OPERATING AMOUNT |

FIG.13

| WORK | CHARACTRISTIC AMOUNT | | | | | | | |
|---|---|---|---|---|---|---|---|---|
| | BOOM OPERATING COMPLICA-TEDNESS | BUCKET OPERATING COMPLICA-TEDNESS | HIGH SPEED SWING TIME | BUCKET AND ARM STOP TIME | BOOM REVERSING OPERATING TIME | BOOM OPERATING AMOUNT AVERAGE VALUM | ARM OPERATING AMOUNT AVERAGE VALUM | BUCKET OPERATING AMOUNT AVERAGE VALUM |
| SIMPLE EXCAVATION | SMALL | SMALL | SMALL | SMALL | SMALL | LARGE | MEDIUM | LARGE |
| FINISHING | SMALL | SMALL | SMALL | SMALL | LARGE | LARGE | LARGE | MEDIUM |
| CHANNEL EXCAVATION | SMALL | SMALL | SMALL | SMALL | SMALL | LARGE | LARGE | LARGE |
| HOLIZONTAL EXCAVATION | SMALL | SMALL | SMALL | SMALL | SMALL | LARGE | LARGE | SMALL |
| SWINGING GROUND-LEVELING | SMALL | SMALL | MEDIUM | LARGE | SMALL | MEDIUM | MEDIUM | SMALL |
| SLOPE TAMPING | LARGE | SMALL | SMALL | LARGE | SMALL | LARGE | SMALL | SMALL |
| SCATTERING | SMALL | LARGE | SMALL | – | – | – | – | – |
| PRESSING EXCAVATION | SMALL | SMALL | LARGE | SMALL | SMALL | MEDIUM | LARGE | LARGE |
| CRANE | SMALL | SMALL | SMALL | SMALL | SMALL | SMALL | SMALL | SMALL |

FIG. 14

| WORK | OPERATING CHARACTERISTIC SET VALUE Pki | | | |
|---|---|---|---|---|
| | HYDRAULIC PUMP ABSORBING HORSE POWER (k=1) | MAXIMUM SUPPLY FLOW-RATE (k=2) | FLOW-RATE CHANGE DEGREE (k=3) | RESPONSE TIME CONSTANT (k=4) |
| SIMPLE EXCAVATION (i=1) | 100% | 100% | LARGE(1.0) | 0 sec |
| FINISHING(i=2) | 80% | 70% | MEDIUM (0.8) | 0.5 sec |
| CHANNEL EXCAVATION(i=3) | 100% | 100% | SMALL(0.7) | 0.2 sec |
| HOLIZONTAL EXCAVATION (i=4) | 80% | 100% | MEDIUM(0.8) | 0.3 sec |
| SWINGING GROUND-LEVELING(i=5) | 80% | 100% | MEDIUM (0.8) | 0.3 sec |
| SLOPE TAMPING (i=6) | 80% | 80% | LARGE (1.0) | 0 sec |
| SCATTERING(i=7) | 80% | 80% | LARGE (1.0) | 0 sec |
| PRESSING EXCAVATION (i=8) | 100% | 100% | LARGE(1.0) | 0 sec |
| CRANE (i=9) | 70% | 70% | SMALL (0.7) | 0.5 sec |

FIG. 15

| WORK GROUP | GROUP No. | WORK |
|---|---|---|
| EXCAVATION | 1 | SIMPLE EXCAVATION, CHANNEL EXCAVATION, PRESS EXCAVATION |
| FINISHING | 2 | NORMAL FINISHING |
| GROUND-LEVEL | 3 | HORIZONTAL GROUND-LEVEL, SWINGING GROUND-LEVEL |
| SLOPE TAMPING | 4 | SLOPE TAMPING |
| SCATTERING | 5 | SCATTERING |
| CRANE | 6 | CRANE |

FIG. 16

| WORK GROUP | OPERATING CHARACTERISTIC SET VALUE Pki | | | |
|---|---|---|---|---|
| | HYDRAULIC PUMP ABSORBING HORSE POWER (k=1) | MAXIMUM SUPPLY FLOW-RATE (k=2) | FLOW-RATE CHANGE DEGREE (k=3) | RESPONSE TIME CONSTANT (k=4) |
| EXCAVATION(i=1) | 100% | 100% | LARGE(1.0) | 0 sec |
| FINISHING(i=2) | 80% | 70% | MEDIUM(0.8) | 0.5 sec |
| GROUND-LEVEL(i=3) | 80% | 100% | MEDIUM(0.8) | 0.3 sec |
| SLOPE TAMPING(i=4) | 80% | 80% | LARGE(1.0) | 0 sec |
| SCATTERING(i=5) | 80% | 80% | LARGE(1.0) | 0 sec |
| CRANE(i=6) | 70% | 70% | SMALL(0.7) | 0.5 sec |

CONTROL APPARATUS FOR A HYDRAULIC EXCAVATOR

BACKGROUND OF THE INVENTION

1. Field of the Invention

The present invention relates to a control apparatus for a hydraulic excavator, and more specifically, to a control apparatus for a hydraulic excavator for controlling a hydraulic excavator using a fuzzy inference.

2. Description of the Related Art

The work machine such as a hydraulic excavator performs many works such as a scattering work, a slope tamping work, a normal finishing work, a crane work, a press-excavating work, a loading work, a swing ground-leveling work, a simple excavating work, a channel excavating work, a horizontal ground-leveling work, etc., and the operating characteristics suitable for these works are different. Therefore, some work modes are prepared, and the work mode has been switched by performing switching operation manually by an operator. However, since the switching operation is complicated, the work mode has not been digested for use sufficiently.

In view of the foregoing, a technique for automatically carrying out a work discrimination in order to switch the work mode has been developed. However, in the actual excavating work, only a specific work is less accomplished, and a plurality of works are combined, for example, such that the excavating work is first carried out, and the finishing work is then carried out. Switching to these works is often carried out.

It is now supposed that the maximum flow-rate of a hydraulic pump is set to 100% for the simple excavating work, and 70% for the normal finishing work, respectively. It is further supposed that an operator performed the work for shifting to the simple excavation from the normal finishing. Then, the maximum flow-rate of the hydraulic pump rapidly changes from 70% to 100% whereby the operator feels a considerable shock, as a consequence of which the operability of the hydraulic excavator is sometimes greatly impaired.

Further, historical data of each operating amount for a fixed time (for example, for 15 seconds) are necessary in order to extract each characteristic amount necessary for work discrimination. When an operator switches the operation within the fixed time, data for different kind of work are mixed within the historical data of the operating amount, and an error tends to occur in discrimination of work. Accordingly, where an operator switches the operation from the excavating work to the operation for the normal finishing work, operation different from the normal finishing work is discriminated immediately before the result of discrimination is decided to the excavating work, as a consequence of which the work is sometime switched to a work mode that is not intended by an operator. A sense of incongruity of operation caused by switching to the work not intended as described above is conspicuously felt by an operator and as a result, the operability of the hydraulic excavator is sometimes impaired.

SUMMARY OF THE INVENTION

It is an object of the present invention to provide a control apparatus for a hydraulic excavator capable of minimizing a shock or a sense of incongruity when operation is switched to enhance an operability of a hydraulic excavator.

A control apparatus for a hydraulic excavator according to the present invention comprises an operating amount detection means for detecting operating amounts of operating levers corresponding to actuators for works of a hydraulic excavator; a characteristic amount operation means for operating a characteristic amount showing a characteristic of operation of a hydraulic excavator on the basis of the operating amount detected; a membership function memory means for storing a plurality of membership functions for a fuzzing inference preset corresponding to the characteristic amounts by kinds of work; a fitness operation means for operating fitnesses relative to the works of the characteristic amount operated by applying the operated characteristic amount to the stored membership function; an operating characteristic set value memory means for storing operating characteristic set values preset corresponding to operating characteristics by kinds of work; and an operating characteristic output means for outputting fitnesses operated corresponding to a plurality of kinds of work and operating characteristics for controlling a hydraulic excavator on the basis of the operating characteristics set values stored.

In this case, operating amounts of operating levers corresponding to actuators for works of a hydraulic excavator are detected by an operating amount detection means, a characteristic amount showing a characteristic of operation of a hydraulic excavator on the basis of the operating amount detected is operated by a characteristic amount operation means, a plurality of membership functions for a fuzzing inference preset corresponding to the characteristic amounts by kinds of work are stored by a membership function memory means, and the characteristic amounts operated are applied to the membership functions stored whereby fitnesses relative to the works of the characteristic amounted operated are operated by a fitness operation means. At this time, operating characteristic set values preset corresponding to operating characteristics by kinds of work is stored in an operating characteristic set value memory means, and an operating characteristic output means fitnesses operated corresponding to a plurality of kinds of work and operating characteristics for controlling a hydraulic excavator on the basis of the operating characteristics set values stored are output by an operating characteristic output means. That is, the operating characteristic set value corresponding to a single kind of work is not output without modification but an output value of the operating characteristic obtained from the fitnesses corresponding to a plurality of kinds of work and the operating characteristic set values are output. Thereby, a plurality of fitnesses are generally reflected on the output values of the operating characteristics.

More specifically, for example, a relationship between the characteristic amount and the work is described by a fuzzing rule in advance, so that the fitness to each rule is calculated on the basis of a preset member function, and the output value of the operating characteristic is obtained by an average of load with the fitness to each rule regarded as a weight.

Thereby, the operating characteristic is not switched to a predetermined value in an ON-OFF manner, but an intermediate value is output. For example, where the maximum flow-rate of a hydraulic pump is similar to that of the aforementioned relative art, its output value is 85% which is an intermediate between 100% and 70%.

Accordingly, for example, even where an operator performs the work from the normal finishing to the simple excavation, an intermediate output value other than the operating characteristic set value stored in advance before and after switching of work can be made as a control valve, and therefore, the maximum flow-rate of the hydraulic pump is not changed stepwise, but changed staircase-wise to make the switching of the operating characteristic smooth.

Further, even where data of different kinds of works are mixed in the operating amount historical data, the control in consideration of fitnesses is employed, as compared to the ON-OFF switching, and even an erroneous discrimination, i.e., where the fitness of work that is not intended by an operator increase, the influence on the operating characteristics is averaged to reduce a sense of incongruity of operation.

Further, suppose that the operating characteristic set values are grouped by kinds of work having the same operating characteristic, and the operating characteristic for controlling a hydraulic excavator is output on the basis of the fitness and the operating characteristic set value by work group, a specific operating characteristic appears repeatedly to enable preventing the operating characteristic form being stressed.

More specifically, for example, a relationship between each characteristic amount and each work group is described in a fuzzy rule, the fitness to each rule is calculated on the basis of a preset membership function, and an output value of the operating characteristic is obtained by an average of load with the fitness to the rule being a weight using the operating characteristic values set by each work group.

As a result, in any case, it is possible to minimize a shock or a sense of incongruity when operation is switched to enhance the operating characteristic of the hydraulic excavator.

BRIEF DESCRIPTION OF THE DRAWINGS

FIG. 1 is a block diagram showing a schematic constitution of a control apparatus according to Embodiment 1 of the present invention;

FIG. 12 is a view illustrating a manner of grasping a complicatedness display amount according to the present invention;

FIG. 13 is a view showing a relationship between work kind and characteristic amount according to the present invention;

FIG. 14 is a view illustrating setting of operating characteristic set value Pki and memory method according to the present invention;

FIG. 15 is a view illustrating a work grouping according to the present invention; and FIG. 16 is a view illustrating a relationship between each work group and operating characteristic set value according to the present invention.

DESCRIPTION OF THE PREFERRED EMBODIMENTS

The preferred embodiments of the present invention will be described hereinafter with reference to the accompanying drawings. It is to be noted that the following embodiments are concrete examples of the present invention, and are not intended to limit the technical scope of the present invention.

EMBODIMENT 1

Figure 2:
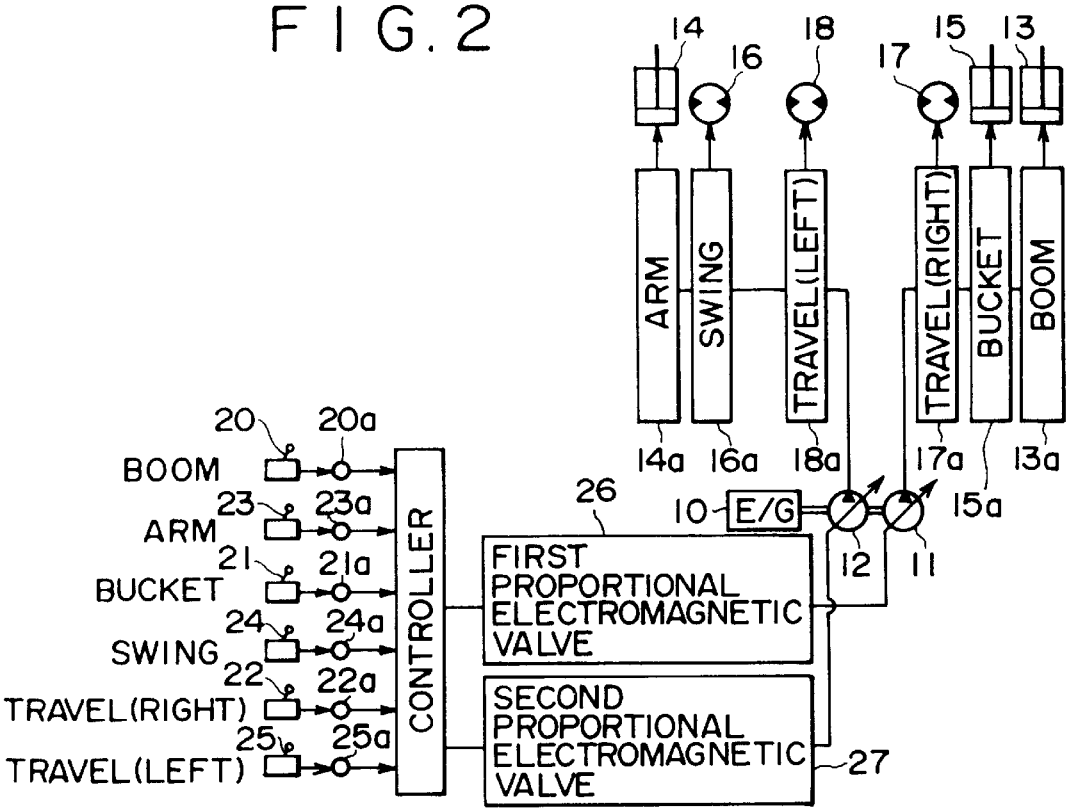
FIG. 2 is a whole system constituent view of a hydraulic excavator including a control apparatus according to Embodiment 1 of the present invention.

FIG. 2 is a whole system constituent view of a hydraulic excavator including a control apparatus according to Embodiment 1 of the present invention. As shown in FIG. 2, The hydraulic excavator comprises, an engine 10, two hydraulic pumps 11, 12 driven by the engine, a hydraulic cylinder for boom 13 as an actuator for work, a hydraulic cylinder 14 for arm, a hydraulic cylinder 15 for bucket, a hydraulic motor 16 for swing, a hydraulic motor 17 for right travel and a hydraulic motor 18 for left travel, and a controller 19 for controlling operation of these devices 1 to 18.

The hydraulic pump 11 supplies pressure oil to the hydraulic cylinder 13 for boom, the hydraulic cylinder for bucket 15 and the hydraulic motor for right travel 17 through control valves 13*a*, 15*a* and 17*a*, respectively, corresponding thereto to drive them. The hydraulic pump 12 supplies pressure oil to the hydraulic cylinder for arm 14, the hydraulic motor for swing 16 and the hydraulic motor for left travel 18 through control valves 14*a*, 16*a* and 18*a*, respectively, corresponding thereto to drive them.

The control valves 13*a* to 18*a* are supplied with pilot pressure oil, from a pilot valve not shown of an operating device comprising an operating lever 20 for boom, an operating lever for bucket 21, an operating lever for right travel 22, an operating lever for arm 23, an operating lever for swing 24 and an operating lever for left travel 25, according to the operating amount and the operating direction of the operating levers 20 to 25, so that the switching operation is carried out. It is noted that for the sake of explanation, the operating levers are separately provided here, but in the actual apparatus, are intended to be common.

The hydraulic pumps 11, 12 are of the variable capacity type, and a tilting angle for controlling the discharge flow-rate can be adjusted, through a regulator not shown, by a secondary pressure generated by a first proportional electromagnetic valve 26 and a second proportional electromagnetic valve 27.

That is, the discharge flow-rate of the hydraulic pumps 11, 12 can be controlled by controlling energization relative to these electromagnetic valves 26, 27.

On the other hand, the hydraulic excavator comprises a boom operating amount sensor 20*a*, a bucket operating amount sensor 21*a*, a right-travel operating amount sensor 22*a*, an arm operating amount sensor 23*a*, a swing operating amount sensor 24*a*, and a left-travel operating amount sensor 25*a*, which are each operating amount sensor (corresponding to an operating amount detection means) 1 for detecting the operating amount including the operating direction of the operating levers 20 to 25, respectively. The operating amount sensor 1 is composed of, for example, a pressure sensor to output a signal according to the operating amount of the operating levers 20 to 25 to the controller 19.

A pipeline not shown is connected to pipelines of the hydraulic pumps 11, 12. Thereby, the hydraulic cylinder for boom 13 and the hydraulic cylinder for arm 14 are supplied with pressure oil from both the pumps, and when the actuators are not in operation, pressure is circulated to a tank not shown.

FIG. 1 is a block diagram showing a schematic constitution of a control apparatus (hereinafter, referred to as "the present apparatus") according to Embodiment 1 of the present invention. As shown in FIGS. 1 and 2, the controller 19 constituting a main part of the present apparatus is composed of, for example, a microcomputer. The functional constitution thereof comprises an A/D converter 28 for A/D-converting an output signal from the operating amount sensor 1, a data retaining portion 29 for retaining data showing the operating amount of the D/A converted operating levers 20 to 25 for a continuous fixed time (for example, 20 seconds) and updating it, for example, every 5 seconds, a characteristic amount extraction portion (corresponding to a characteristic operation means) 2 for extracting the characteristic amount showing the characteristic of a hydraulic excavator on the basis of the data retained, a membership function memory portion (corresponding to a membership function memory means) 3 for storing a plurality of membership functions for fuzzy inference preset corresponding to the characteristic amount by kinds of work, and a fitness operation portion (corresponding to a fitness operation means) 4 for operating fitnesses relative to works of the characteristic amounts operated by applying to the membership functions stored.

Further, the characteristic amount extraction portion 2 comprises a boom operation complicatedness grasping portion 31, an arm operation complicatedness grasping portion 32, a bucket operation complicatedness grasping portion 33, a high speed swing time grasping portion 34, a boom reversing operation time grasping portion 35, a bucket and arm stop time grasping portion 36, boom operation average time grasping portion 37, an arm operation average value grasping portion 38, and a bucket operation average value grasping portion 39, for grasping a plurality of characteristic amounts described later from the operating amount data for a fixed time of the operating levers 20 to 25 retained in the data retaining portion 29 respectively, the fitness operation portion 4 being designed so that a membership function stored in the membership function memory portion 3 is used to obtain a fitness by kinds of work of the characteristic amount grasped by the grasping portions 31 to 39 as work takes place.

However, the controller 19 comprises an operating characteristic set value memory portion (corresponding to an operating characteristic set value memory means) 5 for storing operating characteristic set vales preset corresponding to the operating characteristics by kinds of work, and an operating characteristic operation portion (corresponding to an operating characteristic output means) 6 for generally incorporating the fitnesses operated corresponding to all kinds of work and the operating characteristic set values stored, operating and outputting the operating characteristic for controlling a hydraulic excavator having all these matters incorporated.

The hydraulic pump control portion 7 allows the first and second proportional electromagnetic valves 26, 27 to actuate by an output signal from the operating characteristic operation portion 6 of the controller 19.

In the following, the operation of the controller 19 and so on will be explained with reference to FIGS. 3 to 11.

In the present Embodiment 1, kinds of work extracted by the characteristic amount extraction portion 2 have ten kinds, i.e., a simple excavating work, a normal finishing work, a channel excavating work, a horizontal excavating work, a swing ground-leveling work, a slope tamping work, a scattering work, a pressing work, a crane work and a loading work. The outline of the work contents by kinds of work is as follows:

The simple excavating work is a work of pushing the bucket against the ground at a position forward of the vehicle, and withdrawing the bucket this side by the operation of the arm and boom to thereby dig a hole in the ground. The normal finishing work is a work of placing the bucket along the slanting surface by simultaneous operation of the bucket, arm and boom, and actuating the arm and boom in this state to scrape the slanting surface by the bucket. The channel excavating work is a work of pushing the bucket against the ground at a position forward of the vehicle, and withdrawing the bucket this side by the operation of the arm and boom to thereby dig a channel in the ground. The horizontal excavating work is a work of pushing the bucket against the swell portion of the ground at a position forward of the vehicle, and withdrawing the bucket this side by the operation of the arm and boom to thereby dig a swell portion in the ground. The swing ground-leveling work is a work of placing the bucket in contact with the ground, and effecting the swing operation in this state to thereby perform ground-leveling. The slope tamping work is a work of repeating up and down movements of the boom to throw the bucket against the ground to harden the ground. The scattering work is a work of repeating at high speeds a work of scooping earth in the bucket by simultaneous operation of the bucket, arm and boom to scatter the earth by operation of the bucket. The pressing excavating work is a work, where a channel is dug in a longitudinal direction of a vehicle at a position sideways of the vehicle, of pushing the bucket against the ground to pull it while effecting the swing operation to perform excavation. The crane work is a work of lifting an article to be carried at the edge of the bucket through a rope or the like to move the article to be carried. The loading work is a work of loading a hydraulic excavator on a trailer or the like when the hydraulic excavator is transported.

A boom operation complicatedness grasping portion 31 of the characteristic amount extraction portion 2 for extracting the characteristic amounts by kinds of work grasps, from the operating amount data for the fixed time of the operating lever for boom 20, a rate in which the operating amount of the operating lever is varied to be increased and decreased within the fixed time, as the complicatedness display amount. A bucket operation complicatedness grasping portion 33 grasps, from the operating amount data for the fixed time of the operating lever for bucket 21, a rate in which the operating amount of the operating lever is varied to be increased and decreased within the fixed time, as the complicatedness display amount. An example for obtaining it in a manner as described is shown in FIG. 12.

In the present Embodiment 1, in the boom operation complicatedness grasping portion 31, a waveform a showing a change by time of the operating amount relative to the boom operating lever 20 for the fixed time (for example, 15 seconds), the number of points of intersections P1 to P5 intersecting straight lines b1 to b5 representative of a plurality of operating amounts S1 to S5 (in FIG. 12, −10.0, −5.0, 5.0, 10.0), in other words, the frequency in which the operating amount of the operating lever for boom 20 is changed from the operating amount which is smaller or larger than the operating amounts S1 to S5 to the operating amount which is larger or smaller than the operating amounts S1 to S5 (the frequency which changes above or below the operating amounts S1 to S5) is obtained every operating amount S1 to S5. An average value of the number of the points of intersection P1 to P5 corresponding to the operating amounts S1 to S5 is obtained as a boom operation complicatedness display amount ch1.

Figure 3:
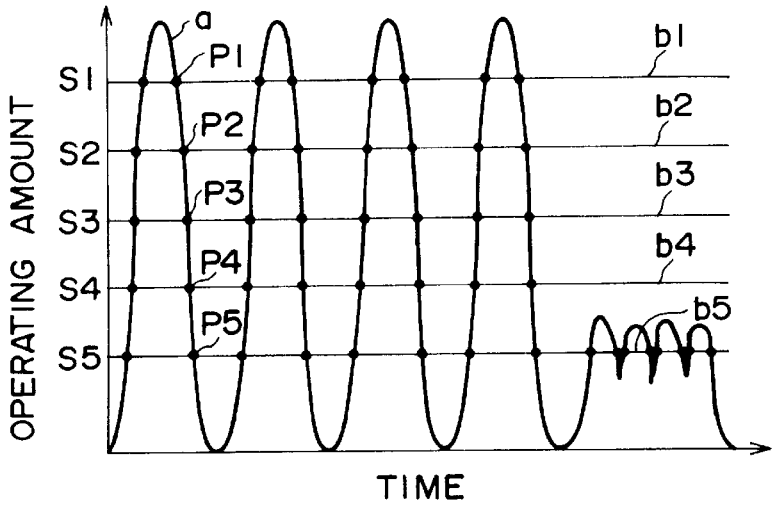
FIG. 3 is an explanatory view of operation of a control apparatus according to Embodiment 1 of the present invention.
Figure 4:
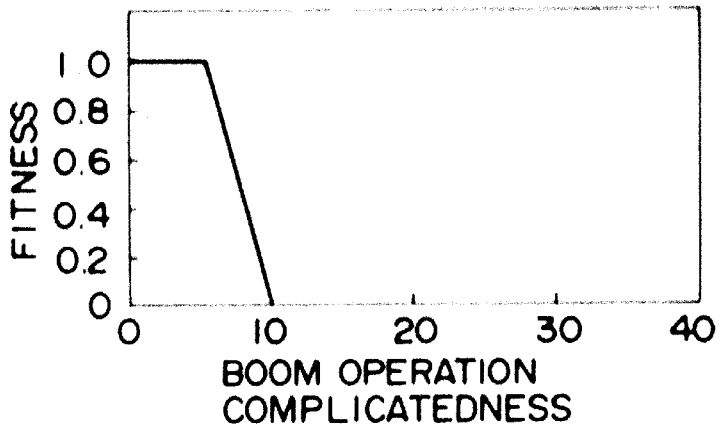
FIG. 4 illustrates a membership function with respect to the display amount of boom operation complicatedness.
Figure 5:
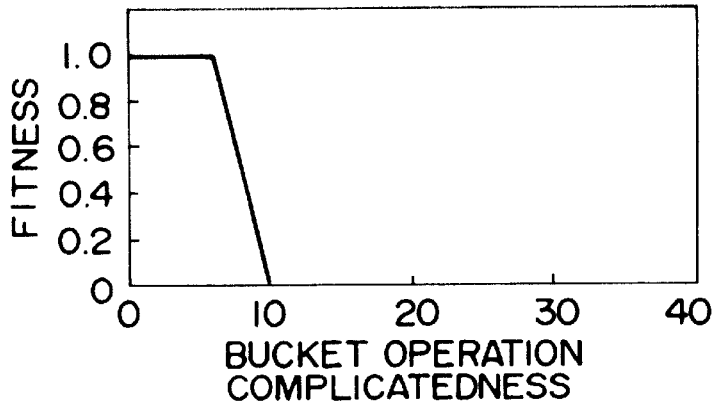
FIG. 5 illustrates a membership function with respect to the display amount of bucket operation complicatedness.

For example, in the waveform a of the operating amount of the operating lever for boom 21 as shown in FIG. 3, the complicatedness display amount corresponding to the fixed operating amounts S1 to S5 is "9.6". The same (how to obtain a complicatedness display amount as described) is true for a complicatedness display amount ch2 of the bucket operation of the bucket operation complicatedness grasping portion 33. However, the operating amounts S1 to S5 are separately determined every operating lever (in FIG. 12, only −5.0).

These complicatedness display amounts ch1 and ch2 of the boom operation and the bucket operation show a degree in which the operating lever for boom 20 and the operating lever for bucket 21 are frequently repeated in increase and decrease within the fixed time, which means that the greater the display amounts ch1 and ch2, the operating levers are frequently operated to be increased and decreased and the complicated boom operation and bucket operation are carried out.

In this case, the average value of the number of points of intersection P1 to P5 with straight lines b1 to b5 corresponding to a plurality of fixed operating amounts S1 to S5 is made to be the complicatedness display amount of the boom operation and the bucket operation, whereby even if the width of increase and decrease in the operating amount of the operating levers is disordered due to the operator's taste, work environment or the like in the same work, a degree in which the operating levers are frequently repeated in increase and decrease (complicatedness of operation) can be properly grasped by the display amounts ch1 and ch2. Further, where the operating amount of the operating lever is increased or decreased with minute width of increase or decrease due to the simple vibration or the like, as shown at the right part in FIG. 3, it is possible to eliminate the condition of misconception that the operating lever is frequently operated in increase and decrease. With respect to the complicatedness display amount, the minimum valve of the number of the points of intersections P1 to P5 can be obtained as the complicatedness display amount. In that case, in the waveform a in FIG. 3, the complicatedness display amount is "8".

The high speed swing time grasping portion 34 obtains, from the operating amount data for the fixed time of the swing operating lever, the number of time in which the magnitude of the operating amount of the operating lever exceeds a predetermined operating amount (in FIG. 12, 30.0), for example, the total of such time, which is grasped as the display amount ch3 of the high speed swing time. The display amount ch3 of the high speed swing time means the total time in which the high speed swing operation of the hydraulic excavator was carried out within the fixed time.

The bucket and arm stop time grasping portion 36 obtains, from the operating amount data for the fixed time of the operating levers for boom, arm and bucket, the number of time in which the operating amount (absolute value) of the operating lever for boom 20 exceeds a predetermined operating amount (in FIG. 12, 3.0) within a fixed time and the operating amounts (absolute values) of the operating lever for arm 23 and the operating lever for bucket 21 are below a predetermined fixed operating amount (in Table 1, 3.0), for example, the total of such time, which is grasped as the display amount ch4 of the bucket and arm stop time. The display amount ch4 of the bucket and arm stop time means the total time within the fixed time in the state where only the boom is driven in the state where the bucket and the arm substantially stopped.

The boom reversing operating time grasping portion 35 obtains, from the operating amount data for the fixed time of the operating levers for boom, arm and bucket, the number of time in which the operating amounts of the operating lever for boom 20 and the operating lever for arm 23 exceed a predetermined operating amount (in FIG. 12, 3.0) on the up side of the boom and the arm within a fixed time and the operating amount of the operating lever for bucket 21 is below a predetermined fixed operating amount (In Table 1, −3.0) on the withdrawn side of the bucket, for example, the total of such time, which is grasped as the display amount ch5 of the boom reversing operating time. The display amount ch5 of the boom reversing operating time means the total time within the fixed time in the state where the boom and the arm are driven on the up side whereas the bucket is driven on the withdrawn side.

A boom operation average value grasping portion 37, an arm operation average valve grasping portion 38 and a bucket operation average value grasping portion 39 obtain, from the operating amount data for the fixed time with respect to the operating levers for boom, arm and bucket, an average value of operating amounts (absolute values) of the operating levers within the fixed time, which is grasped as a display amount ch6 of the boom operating amount average value, a display amount ch7 of the arm operating amount average value, and a display amount ch8 of the bucket operating amount average value.

In the present Embodiment 1, the display amounts ch1 to ch8 grasped by these grasping portions 31 to 39 are employed as the characteristic amounts showing the operating state of the hydraulic excavator. A relationship between the kinds of work and the characteristic amount thus obtained is shown in FIG. 13.

A membership function stored and retained in the membership function memory portion 3 is derived from FIG. 13, which shows a predetermined relationship between values of eight kinds of characteristic amounts such as the complicatedness display amounts of the boom operation and fitnesses of the characteristic amounts corresponding to the kinds of work. The membership functions corresponding to the characteristic amounts are stored and retained in the membership function memory portion 3 every kind of work.

That is, the membership function is set every set of the kinds of work and the characteristic amount. In this case, the membership function corresponding to each set of the kinds of work and the characteristic amounts is basically set so that the fitness is gradually reduced as the fitness corresponding to the value of the characteristic amount is the maximum (in the present embodiment, "1") in the range of the value normally employed by the characteristic amounts in the actual work by kinds of work, and the value of the characteristic amount is deviated from said range.

For example, FIGS. 4 to 11 show an example of the simple excavating work. Since normally, the operating lever for boom 20 and the operating lever for bucket 21 are less operated in increase and decrease frequently in a short period of time, the membership function is set so that the fitness is "1" at the maximum in the range in which the values of the complicatedness display amount of the boom operation and the complicatedness display amount of the bucket operation are relatively low including "0".

Figure 6:
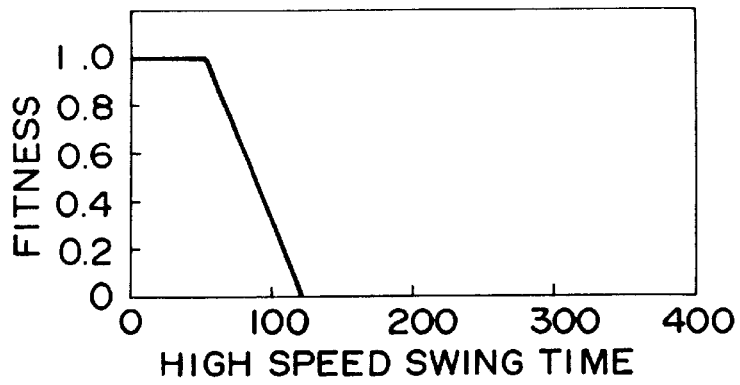
FIG. 6 illustrates a membership function with respect to the display amount of high speed swing time.
Figure 7:
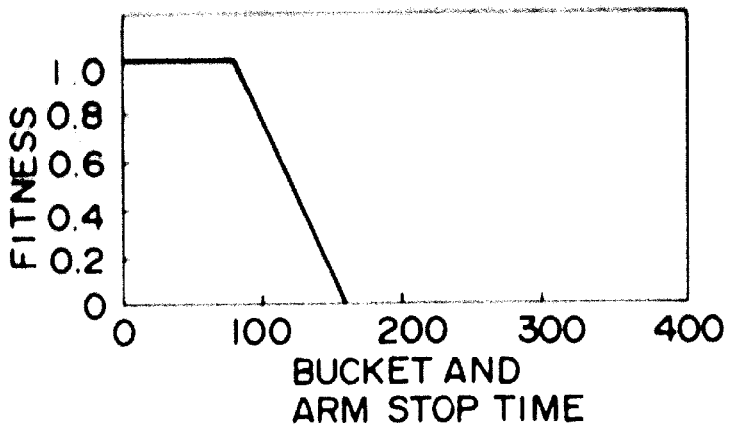
FIG. 7 illustrates a membership function with respect to the display amount of bucket and arm stop time.
Figure 8:
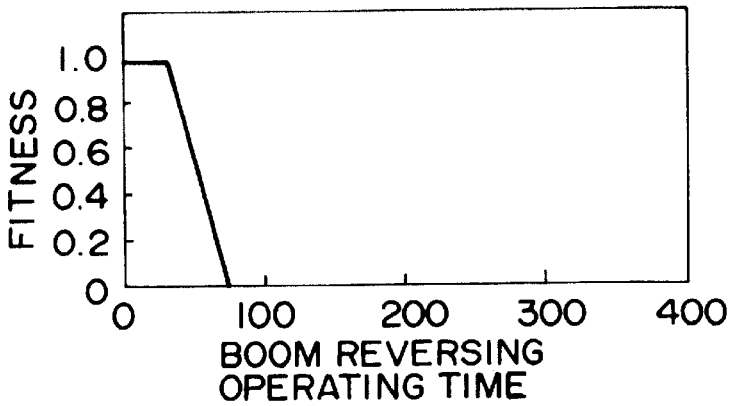
FIG. 8 illustrates a membership function with respect to the display amount of boom reversing operation time.

In the simple excavating work, since normally, the operation for high speed swing, operation for driving only the boom in the state where the bucket and arm are substantially stopped, and operation for driving the bucket and the arm on the withdrawn side while driving the boom up are less in frequency, the membership function is set so that the fitness is "1" at the maximum in the range in which the values of the high speed swing time, the bucket and arm stop time and the boom reversing operation time are relatively low including "0", as shown in FIGS. 6 to 8.

Figure 9:
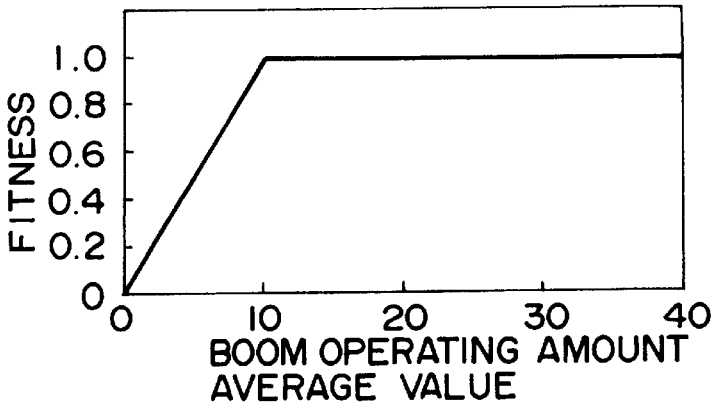
FIG. 9 illustrates a membership function with respect to the display amount of average value of boom operation time.
Figure 11:
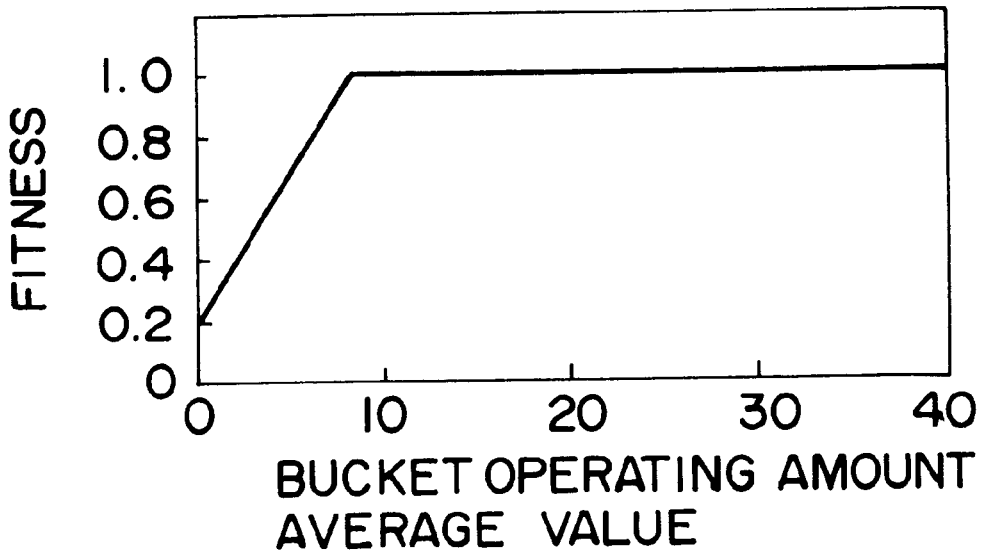
FIG. 11 illustrates a membership function with respect to the display amount of average value of bucket operation time.

Further, in the simple excavating work, since normally, the operating lever for boom 20 and the operating lever for bucket 21 are often operated in the relatively large operating amount, the membership function is set so that the fitness is "1" at the maximum in the range in which the average value of the boom operating amount and the average amount of the bucket operating amount are relatively large in excess of a certain value, as shown in FIGS. 9 and 11.

Figure 10:
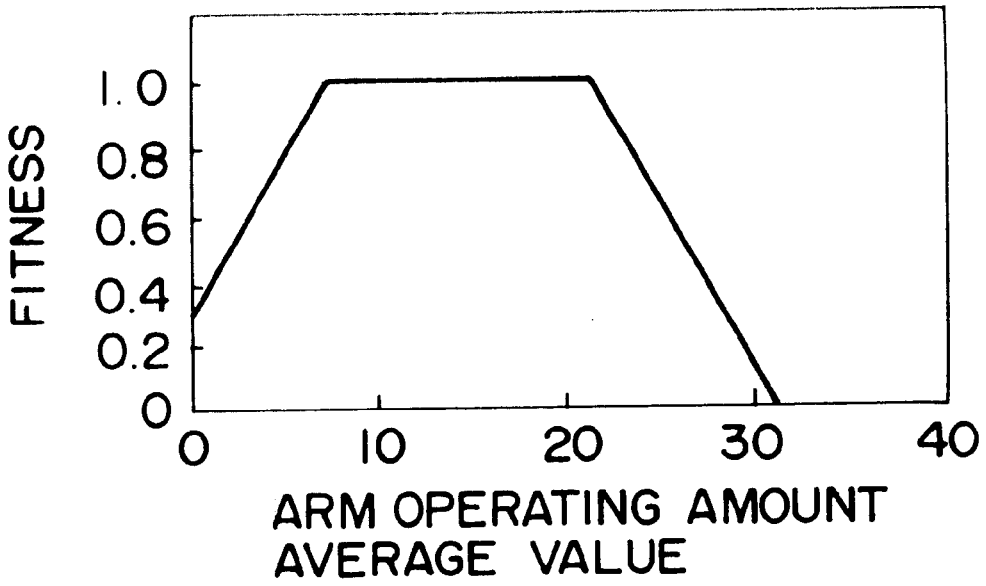
FIG. 10 illustrates a membership function with respect to the display amount of average value of arm operation time.

Since the operating lever for arm 23 is often operated in an approximately intermediate operating amount, the membership function is set so that the fitness is "1" at the maximum in the range in which the average value of the arm operating amount is approximately intermediate, as shown in FIG. 10.

The setting of the membership function with respect to the characteristic amount every kind of work is similarly applied to the other works. The membership function is set so that the fitness corresponding to the value of the characteristic amount is "1" at the maximum in the range of the value that is normally employed in work. Where with respect to the kinds of work, the range of the normal value of the characteristic amount extends over the whole range of the characteristic amount, the membership function is set so that the fitness is "1" at the maximum over the whole range of the characteristic amount.

The fitness operation portion 4 obtains, from the values of the characteristic amounts actually grasped by the grasping portions 31 to 39 during the work, the Witnesses relative to the kinds of work of the characteristic amounts every kind of work using the membership functions set as described above.

More specifically, the fitness operation portion 4 computes, from the logic product or logic sum of the fitness $\mu ij$ (i=1 to 9, j=1 to 8) relative to the characteristic amount of work computed from the membership using the characteristic amounts ch1 to ch8 in Table 1, the fitness hi (i=1 to 9) of work using the following equation:

$$hi=\mu i\mathbf{1}\times\mu i\mathbf{8} \quad \text{(A)}$$

or $$hi=\min(\mu i\mathbf{1}, \ldots, \mu i\mathbf{8}) \quad \text{(B)}$$

Note that i=1 designates the simple excavating work; 2 the normal finishing work; 3 the channel excavating work; 4 the horizontal ground-leveling work; 5 the swing ground-leveling work; 6 the slope tamping work; 7 the scattering work; 8 the pressing excavating work; 9 the crane work, and min ( ) the processing for computing the minimum value.

The operating characteristic set value memory portion 5 comprises a response time constant memory portion 41, an absorption horse power memory portion 42, a flow-rate change memory portion 43, and a maximum supply flow-rate memory portion 44, and an operating characteristic set value Pki requested with respect to the work is set, for example, as shown in FIG. 14, and stored in the memory portions 41 to 44.

That is, the response time constant memory portion 41 stores the response time constant for controlling the change speed of the operating speed of the actuators with respect to the change speed of the operating amount of the operating lever. For example, as sown in FIG. 14, the response time constants are set to 0, 0.2, 0.3, and 0.5 second according to the kinds of work and stored. The smaller the response time constant, the higher the respondence of the operating speed of the actuator when the operating amount of the operating lever is changed. Note that the operation in accordance with the response time constant is carried out, for example, by, when the operating amount of the operating lever is changed, delaying the timing of energization to the first and second proportional electromagnetic valves 26, 27 for generating a change in flow-rate of the hydraulic pumps 11, 12 corresponding thereto by the time of the response time constant.

The absorption horse power memory portion 42 stores a rate of absorbing output of the engine 10 by the hydraulic pumps 11, 12, a so-called absorbing horse power, which sets the hydraulic pump absorbing horse power to 100%, 80% and 70% according to the kinds of work as shown in FIG. 14, for example, and stores them. The hydraulic pump absorbing horse power of 100% shows the coincidence between output torque in rotational frequency of the engine 10 and generated torque of the hydraulic pumps 11, 12, in which state the output of the engine 10 is converted into output of the hydraulic pumps 11, 12 for driving the actuator without modification. Further, the hydraulic pump absorbing horse power of 80% or 70% shows the state where the generated torque of the hydraulic pumps 11, 12 in the rotational frequency of the engine 10 and the output torque are 80% or 70%, in which state, 80% or 70% of the output of the engine 10 is converted into output of the hydraulic pumps 11, 12 for driving the actuator.

The flow-rate change memory portion 43 stores, as the flow-rate change amount, a rate of a static change amount with respect to the flow-rate of pressure oil to the actuator from the hydraulic pumps 11, 12 relative to the change amount of the operating amount of the operating lever, which sets the flow-rate change amount to three kinds, large, medium and small according to the kinds of work, for example, as shown in FIG. 14, and stores them. The larger the flow-rate change amount, the greater the change in increase and decrease of the operating speed of the actuator with respect to the increase and decrease in the operating amount of the operating lever.

The maximum supply flow-rate memory portion 44 stores the maximum supply amount of pressure oil to the actuator from the hydraulic pumps 11, 12, which sets the maximum supply flow-rate to 100%, 80% and 70% according to the kinds of work with the maximum supply flow-rate equal to the allowable maximum discharge flow-rate of the hydraulic pumps 11, 12 being 100% and stores them, for example, as shown in FIG. 14. The greater the maximum supply flow-rate, the higher the maximum operating speed of the actuator caused by the operation of the operating lever.

The operating characteristic operation portion 6 computes an operating characteristic output value Pk (k=1 to 4) using the following equation, from the fitness hi (i=1 to 9) computed by the fitness operation portion 4 and the operating characteristic set value Pki stored in the memory portions 41 to 44 of the operating characteristic set value memory portion 5. That is, a load average with a fitness to a fuzzy rule describing a relationship between the characteristic amount and the work of the operating characteristic set value set every work being a weight is employed as an output value of the operating characteristic.

$$Pk=(h1\cdot Pk+\ldots+h9\cdot Pk9)/(h1+\ldots+h9) \quad (C)$$

The hydraulic pump control portion 7 decides, in accordance with the operating characteristic output value Pk from the operating characteristic operation portion 6, an amount of energization to the first and second proportional electromagnetic valves 26, 27 so that pressure oil of flow-rate according to momentary operating amount of the operating lever is supplied to the actuator, whereby the electromagnetic valves 26, 17 are energized to thereby control the discharge flow-rate of the hydraulic pumps 11, 12.

According to the present Embodiment 1, the operating characteristic set value corresponding to the simple kind of work is not output without modification, but the output value of the operating characteristic obtained from the fitness corresponding to the whole kinds of work and the operating characteristic set value is output. Thereby, all the fitnesses are reflected on the output value of the operating characteristic.

More specifically, for example, a relationship between the characteristic amount and the work is described in advance in a fuzzy rule, the fitness to the rule is computed on the basis of the preset membership function, and the output value of the operating characteristic is obtained by the load average with the fitness to the rule being a weight using the operating characteristic value set every work.

Thereby, the operating characteristic is not switched in an ON-OFF manner to a predetermined value, but an intermediate value is output. For example, the maximum flow-rate of the hydraulic pump is set to 100% and 70% for the simple excavating work and the normal finishing work, respectively. Where an operator performs the work from the normal finishing to the simple excavation, its output value is 85%, which is intermediate between 100% and 70%.

Accordingly, even where such a combined work is performed, it is possible to take an intermediate control value other than values set in advance before and after the switching of work, and therefore, the maximum flow-rate of the hydraulic pump is not changed stepwise, but changed stairwaywise, thus making the switching of the operating characteristic smooth.

Further, even where data of different kinds of work are mixed in the operating amount historical data, control in consideration of the fitness is provided as compared to the ON-Off switching. Even where erroneous discrimination, or fitness of work not intended by an operator is large, the influence on the operating characteristics is averaged, thus reducing a sense of incongruity of operation. As a result, it is possible to enhance the operating characteristic of the hydraulic excavator.

While in the present Embodiment 1, the output value of the operating characteristic is obtained by the load average with the fitness to the fuzzy rule representative of a relationship between the characteristic amount and the work using the operating characteristic values set every work, it is to be noted that in place of the weight by the fitness, or in addition to the weight by the fitness, a weighting designated by an operator may be employed. In this case, the operator's experiences reflect on the output value to enhance more practical operability. Further, it is of course that such a weighting be done by learning.

Further, while in the present Embodiment 1, the fitness corresponding to all the kinds of work prepared in advance and the operating characteristic set value are used as basis, it is to be noted in the present invention that the fitness corresponding to at least two kinds of work or more and the operating characteristic set value be selected to operate the composite operating characteristic output value, thus obtaining excellent effects.

EMBODIMENT 2

In the above-described Embodiment 1, computation of the operating characteristic output value Pk is carried out using the operating characteristic set value Pki set every work. However, as will be understood from FIG. 14, for example, the simple excavating work, the channel excavating work and the pressing excavating work are set to exactly the same operating characteristics (Pump absorbing horse power=100%, maximum supply flow-rate=100%, weight change degree=1.0, and response time constant=0 second).

In this case, if computation is carried out using the above-described equation (A), a certain specific operating characteristic is stressed. Because, for example, pump absorbing horse power=100% appears three times repeatedly in the above-described equation (A). Accordingly, if any inconvenience should occurs thereby, it is contemplated that the work be grouped. Specifically, the work grouping as shown in FIG. 15, for example, is contemplated.

Here, the simple excavating work, the channel excavating work and the pressing excavating work are represented by Group No. 1 as the excavating work, and other works are similarly grouped and represented by Group Nos. 2 to 6, respectively. Where the work is grouped as described above, the aforementioned symbol i means the work group number. Then a relationship between the work group and the operating characteristic set value is as in FIG. 16.

However, the fitness hgi (i=1 to 6) of the work group is the maximum value of the fitness of the work belonging to the work group, and is computed, in the present Embodiment 2, by the following equation (D). That is, here also, the load average with the fitness to the fuzzy rule describing a relationship between the characteristic amount and the work of the operating set value set every work being a weight is the output valve of the operating characteristic, similarly to the above-described Embodiment 1.

$$hg1=\max(h1, h3, h8)$$

$$hg2=h2$$

$$hg3=\max(h4, h5)$$

$$hg4=h6$$

$$hg5=h7$$

$$hg6=h9 \quad (D)$$

In this case, in the operating characteristic operation portion 6, the operating characteristic output value Pk (k=1 to 4) is computed using the following equation (E) from the fitness hgi (i=1 to 6) of the work group computed by the fitness operation portion 4 and the operating characteristic set value Pki stored in the memories 41 to 44 of the operating characteristic set value memory portion 5. That is, the load average with the fitness to the fuzzy rule describing a relationship between the characteristic amount and the work of the operating set value set every work being a weight is the output valve of the operating characteristic.

$$Pk=(hg1\cdot Pk1+\ldots+hg6\cdot Pk6)/(hg1+\ldots+hg6) \quad \text{(E)}$$

In the hydraulic pump control portion 7, the discharge amount of the hydraulic pump is controlled through the first and second proportional electromagnetic valves 26, 27 in accordance with the operating characteristic output value Pk from the operating characteristic operation portion 6.

From the foregoing, according to the present Embodiment 2, it is possible to prevent such a situation that where exactly the same works are present, they are grouped so that a certain specific operating characteristic appears repeatedly whereby the operating characteristic is stressed, to enhance the operability.

Note that the present Embodiment 2 is exactly the same in constitution as hat of the above-described Embodiment 1 except the grouping mentioned above. Accordingly, other operations and effects are exactly the same as those of the above-described Embodiment 1.

We claim:

1. A control apparatus for a hydraulic excavator comprising:

an operating amount detection means for detecting operating amounts of operating levers corresponding to actuators for works of a hydraulic excavator;

a characteristic amount extraction means for extracting a characteristic amount showing a characteristic of operation of a hydraulic excavator on the basis of the operating amount detected;

a membership function memory means for storing a plurality of membership functions for a fuzzy inference preset corresponding to the characteristic amounts by kinds of work;

a fitness operation means for operating fitnesses relative to the works of the characteristic amount extracted by applying the characteristic amounts to the membership functions;

an operating characteristic set value memory means for storing operating characteristic set values preset corresponding to operating characteristics by kinds of work; and an opening characteristic output means for outputting fitnesses operated corresponding to a plurality of kinds of work and operating characteristics for controlling a hydraulic excavator on the basis of the operating characteristics set values stored.

2. The control apparatus for a hydraulic excavator according to claim 1, wherein said operating characteristic output means is designed so that a load average with a fitness to a fuzzy rule describing a relationship between each characteristic amount and each work of an operating characteristic set value set every work being a weight is an output value of the operating characteristic.

3. The control apparatus for a hydraulic excavator according to claim 1, wherein said operating characteristic set value is grouped every kind of work having the same operating characteristic, and an operating characteristic for controlling the hydraulic excavator is output on the basis of the fitness every work group and the operating characteristic set value.

4. The control apparatus for a hydraulic excavator according to claim 3, wherein said operating characteristic output means is designed so that a load average with a fitness to a fuzzy rule describing a relationship between each characteristic amount and each work of an operating characteristic set value set every work being a weight is an output value of the operating characteristic.

5. The control apparatus for a hydraulic excavator according to claim 1, including a boom work, an arm work, a bucket work, and a swing work by said kinds of work.

6. A control apparatus for a hydraulic excavator comprising:

an operating amount detection means for detecting operating amounts of operating levers corresponding to actuators for works of a hydraulic excavator;

a characteristic amount extraction means for extracting a characteristic amount showing a characteristic of operation of a hydraulic excavator on the basis of the operating amount detected;

a membership function memory means for storing a plurality of membership functions for a fuzzy inference preset corresponding to the characteristic amounts by kinds of work; and a fitness operation means for operating fitnesses relative to the works of the characteristic amount extracted by applying the operated characteristic amounts to the stored membership functions, characterized by comprising, an operating characteristic set value memory means for storing operating characteristic set values preset corresponding to operating characteristics by kinds of work, and an operating characteristic output means for outputting fitnesses operated corresponding to a plurality of kinds of work and operating characteristics for controlling a hydraulic excavator on the basis of the operating characteristics set values stored.

* * * * *